US007431234B2

(12) United States Patent
Ballestrazzi et al.

(10) Patent No.: US 7,431,234 B2
(45) Date of Patent: Oct. 7, 2008

(54) AUTOMATIC REEL UNWINDING APPARATUS IN A MACHINE FOR PACKAGING PRODUCTS

(75) Inventors: Aris Ballestrazzi, Savignano Sul Panaro (IT); Lamberto Tassi, Savignano Sul Panaro (IT)

(73) Assignee: SITMA S.p.A., Modena (IT)

( * ) Notice: Subject to any disclaimer, the term of this patent is extended or adjusted under 35 U.S.C. 154(b) by 399 days.

(21) Appl. No.: 11/114,678

(22) Filed: Apr. 25, 2005

(65) Prior Publication Data

US 2005/0236510 A1 Oct. 27, 2005

(30) Foreign Application Priority Data

Apr. 27, 2004 (IT) ..... MI2004A0832

(51) Int. Cl.
*B65H 19/14* (2006.01)

(52) U.S. Cl. ..... 242/552; 242/554.2; 242/554.3

(58) Field of Classification Search ..... 242/555, 242/552, 554.2–554.3, 555.1, 555.3, 555.5–555.6, 242/559.3, 417.1–417.2
See application file for complete search history.

(56) References Cited

U.S. PATENT DOCUMENTS

| | | | | | |
|---|---|---|---|---|---|
| 1,885,262 | A | | 11/1932 | Horton | |
| 1,967,056 | A | * | 7/1934 | Horton | 242/420.2 |
| 3,071,333 | A | * | 1/1963 | Looser | 242/555.5 |
| 3,486,708 | A | * | 12/1969 | Lamon | 242/422.1 |
| 3,647,600 | A | | 3/1972 | Vischulis et al. | |
| 3,775,223 | A | * | 11/1973 | Moseley et al. | 156/502 |
| 3,907,235 | A | | 9/1975 | Gaubert et al. | |
| 4,233,104 | A | | 11/1980 | Fujishima et al. | |
| 4,492,609 | A | | 1/1985 | Blom et al. | |
| 4,543,152 | A | * | 9/1985 | Nozaka | 156/502 |
| 4,655,865 | A | * | 4/1987 | Nozaka | 156/157 |
| 5,114,088 | A | | 5/1992 | Cardano | |
| 5,692,698 | A | * | 12/1997 | Forbes | 242/533.4 |
| 5,833,168 | A | * | 11/1998 | Tahata et al. | 242/559.2 |
| 6,096,150 | A | * | 8/2000 | Ohno | 156/157 |

FOREIGN PATENT DOCUMENTS

| | | |
|---|---|---|
| EP | 1 266 851 A | 12/2002 |
| GB | 934 117 A | 8/1963 |

OTHER PUBLICATIONS

EPO Search Report.

* cited by examiner

*Primary Examiner*—Sang Kim
(74) *Attorney, Agent, or Firm*—James V. Costigan; Hedman & Costigan, P.C.

(57) ABSTRACT

An automatic reel unwinding apparatus in a machine for packaging products having a bearer structure (14, 15) carrying a pair of rotating arms (16), centrally hinged to the bearer structure (15) through a rotation shaft (17) and carrying at their ends, on two shafts (18, 18'), at least a pair of reels (12, 12'), the rotation shaft (17) being commanded through a speed reducer (20) and each of the two shafts (18, 18') being commanded by a motor reducer (21) through a respective transmission (22) able to be selectively engaged with the motor reducer, the withdrawable shafts (18, 18') being fixed to at least one openable support (19, 19') arranged at an end of the arms (16).

5 Claims, 2 Drawing Sheets

AUTOMATIC REEL UNWINDING APPARATUS IN A MACHINE FOR PACKAGING PRODUCTS

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON AS COMPACT DISK

Not Applicable

BACKGROUND OF THE INVENTION

1) Field of the Invention

The present invention refers to an automatic reel unwinding apparatus for use in a machine for packaging products.

2) Description of Related Art

In apparatuses for packaging with a film of plastic material or similar, for use in the continuous packaging of large quantities, reels of film with a large diameter are used that must be arranged on a motorised unwinding rotation shaft as a suitable unwinding group. The large diameter reels on the one hand allow for a certain degree of autonomy of operation of the packaging machine, on the other hand they also involve a certain idle time for the entire packaging machine when the spent reel is changed for a new reel.

Moreover, it should be noted that the large diameter of the reel makes it difficult to manipulate. Indeed, in order to be able to proceed to the installation of a new reel on the rotation shaft, once the card core of the spent reel has been removed, an overhead travelling crane or alternatively a so-called loading mule is usually used. With these means it is also not very easy to carry out an immediate centering of the new reel with respect to the rotation shaft and the unwinder.

Therefore, in addition to the time required a suitable means must be used to carry out such a replacement.

This means that the production costs are increased, and large maneuvering spaces are needed to carry out replacement of the reel.

The suspended loads also create dangerous conditions at sites that otherwise could be safer if this type of problem was avoided.

The purpose of the present invention is to solve such problems, by carrying out a quick and safe replacement of the new reel of film, with minimum use of auxiliary lifting and manipulation means.

Another purpose of the invention is that of minimising the idle times so as to maintain the packaging machine at a high productivity.

BRIEF SUMMARY OF THE INVENTION

These purposes according to the present invention are accomplished by making an automatic reel unwinding apparatus in a machine for packaging products, according to what is outlined in the attached independent claim.

Other characteristics emerge from the subsequent attached claims.

The characteristics and advantages of an automatic reel unwinding apparatus in a machine for packaging products according to the present invention shall become clearer from the following description, given as an example and not for limiting purposes.

DETAILED DESCRIPTION OF THE INVENTION

Figure 1:
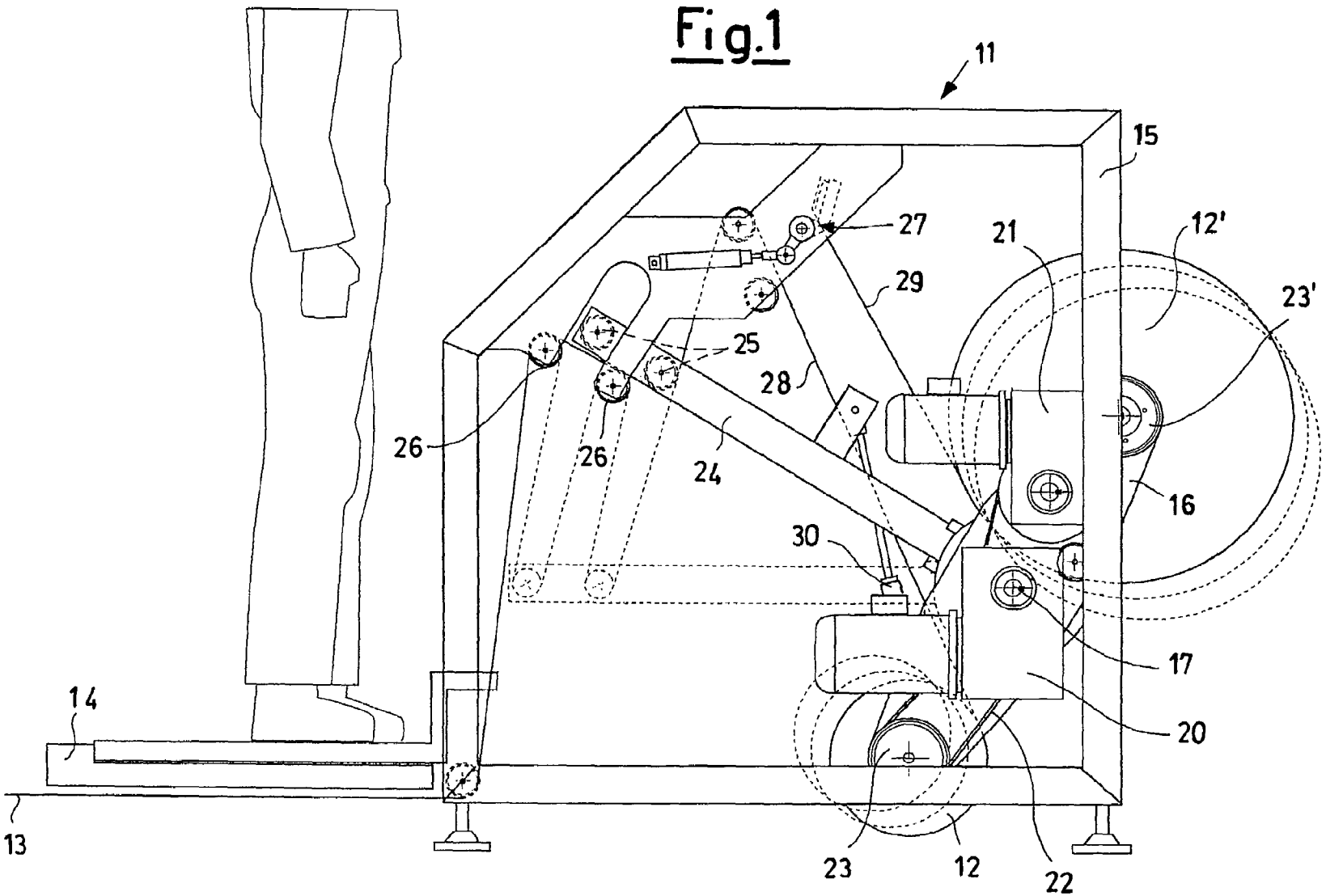
FIG. 1 is a side elevation view of an automatic reel unwinding apparatus for a machine for packaging products according to the present invention.
Figure 2:
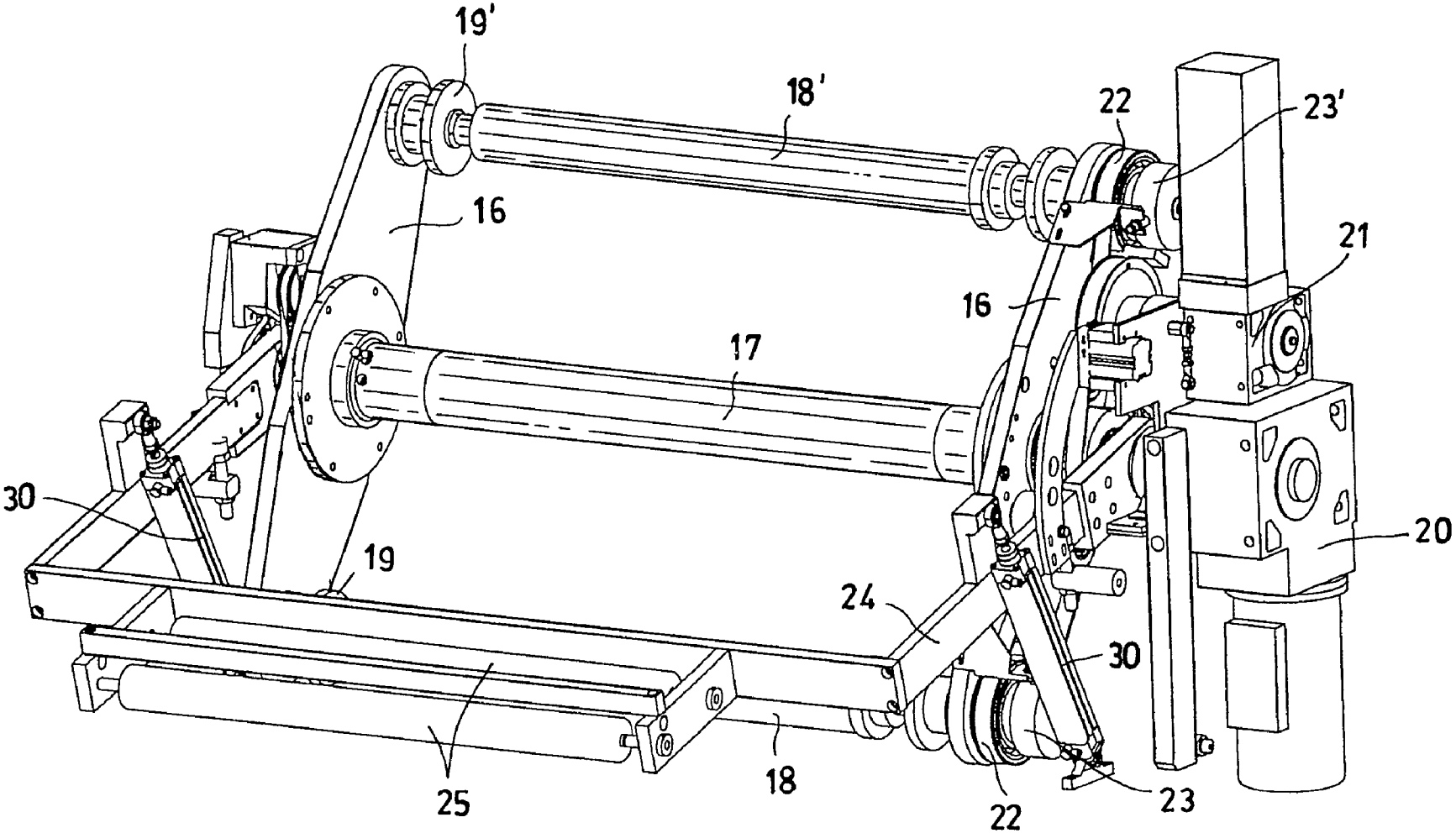
FIG. 2 is a perspective view of part of the apparatus of FIG. 1, without the bearer structure.

With reference to the figures, an automatic reel unwinding apparatus 11 in a machine for packaging products (not shown) is schematically illustrated. The unwinding apparatus 11 carries at least one reel 12 from which a film 13 unwinds and passes beneath a platform 14 forming part of a bearer structure 15.

The unwinding apparatus 11 comprises, on the aforementioned bearer structure 15, a pair of rotating arms 16, hinged centrally to the bearer structure 15 through a rotation shaft 17.

The rotating arms 16 carry at their end, on two shafts 18, 18', which may be freely withdrawn from the ends of the two arms 16, a pair of reels 12, 12'. More specifically, the two shafts 18, 18' are fixed through at least one openable support 19, 19' arranged close to an end of each of the two arms 16.

The rotation shaft 17 is made to rotate through a speed reducer 20 that allows each of the shafts 18, 18' to be positioned with the respective reel 12, 12' in the required operating position for the operation of the apparatus 11.

The unwinding of the reel 12, which in FIG. 1 is in an almost spent operating position, takes place because of the rotation of the respective shaft 18. Indeed, each of these shafts 18, 18' is made to rotate by a speed reducer 21 that commands belts 22 acting on clutches 23, 23' that determine the selective engagement and/or disengagement of the respective shaft 18, 18'. It should be noted that both the speed reducer 21 and the respective transmission 22 are arranged integral with one of the arms 16.

A U-shaped support bracket 24, on which freely rotatable idle rollers 25 are arranged, is also supported on the central shaft 17, which are free to oscillate about the shaft 17 itself. Further idle rollers 26, integral at their ends with the fixed bearer structure 15, form storage means (so-called dandy rolls) with the previous idle rollers 25 for the insertion of the film 13 unwinding from the almost spent first reel 12. Between the U-shaped support bracket 24 and the bearer structure 15, cylinders 30 are arranged suitable for making compensator elements for maintaining the tension of the film according to the operating speed of the packager. Indeed, such cylinders keep the U-shaped support bracket 24 in the suitable position for promoting a suitable oscillation thereof.

In the top part of the bearer structure 15, fastening and cutting means are positioned between an end portion 28 of film of the almost spent first reel 12 and an initial portion 29 of film of a second new reel 12' as schematically shown in FIG. 1 as reference character 27.

The unwinding apparatus 11 according to the present invention, once the end portion 28 of film of the almost spent first reel 12 and the initial portion 29 of film of a second new full reel 12' are joined allows for the rapid positioning of a new reel. The new reel 12' is made to rotate by simply inserting the respective clutch 23' so as to take the shaft 18' into rotation through the belts 22 and the respective speed reducer 21; before this the rotation of the old reel 12, by now almost spent, had been stopped by removing the respective clutch 23 so as to stop the rotation of the shaft 18.

Moreover, once the replacement of the operating reel has been carried out, it is possible to quickly proceed to the positioning of a new reel. This takes place by simply opening the openable support 19, removing the shaft 18 with the respective core of the spent reel 12 from the housing between the two arms 16. Then, by simply pushing a new reel (not shown), which is inserted on a shaft 18 that is similar to the previous one, one simply takes care of arranging the ends between the arms, before finally locking the openable support 19.

At this point the unwinding apparatus 11 can be restarted after a truly limited idle time.

The operating position can then be quickly restored when the unwinding reel is arranged towards the bottom of the apparatus and the reserve reel is arranged in the high part.

In this way all of the aforementioned problems relative to the prior art are avoided, as well as the need for special lifting means for arranging the new reel on the apparatus.

In such a way there is also no need to have many operators to carry out the replacement operations.

Advantageously, moreover, no reels are lifted during the replacement action with the elimination of any possibility of danger.

Consequently, according to the present invention a quick and safe replacement is made possible limiting any loss in productivity of the entire packaging plant to a minimum.

The apparatus of the invention allows reels with large diameters to be used, conserving a certain autonomy of the packaging machine, and on the other hand involves a minimum idle time of the entire packaging machine when the reel is replaced.

It has thus been seen that an unwinding apparatus according to the invention achieves the purposes outlined previously.

Moreover, in practice, the devices, the materials used, as well as their sizes and the components, can be varied according to the specific technical requirements.

The invention claimed is:

1. Automatic reel unwinding apparatus in a machine for packaging products comprising a bearer structure (14, 15) carrying a pair of rotating arms (16), centrally hinged to the bearer structure (15) through a rotation shaft (17) and carrying at each ends, on two shafts (18, 18') that are adapted to be removed from said arms (16), and having at least a pair of reels (12, 12'), said rotation shaft (17) being commanded through a speed reducer (20) and each of said two shafts (18, 18') being commanded by a speed reducer (21) through a respective transmission (22) able to be selectively engaged with the speed reducer, a U-shaped support bracket (24) which is connected to a piston (30), said U-shaped bracket further characterized as having two ends, one end being supported by central shaft (17) so as to allow an opposed end to pivot around said central shaft (17) by action of a cylinder (30), said U-shaped bracket having at least two idle rollers (25,26) attached to said U-shaped bracket (24) fore storage of a film (13), the U-shaped bracket and idle rollers (25,26) being adapted to allow for said film (13) to unwind from a first reel (12) and through a fastening and cutting means (27) so as to fasten an end portion (28) of film of the first reel (12) to an initial portion (29) of film of a second new reel (12'), said removable shafts (18, 18') being fixed to at least one openable support (19, 19') arranged at an end of said arms (16).

2. Unwinding apparatus according to claim 1, characterized in that each removable shaft (18, 18') is associated with a respective clutch (23, 23') that determines the selective engagement or disengagement of the respective shaft (18, 18') from said transmission (22) commanded by said motor reducer (21).

3. Unwinding apparatus according to claim 1, characterized in that said motor reducer (21) and said transmission (22) are arranged integral with one of said arms (16).

4. Unwinding apparatus according to claim 1, characterized in that the replacement of said spent reel (12) takes place with the respective shaft (18) in a position lowered to the ground.

5. Unwinding apparatus according to claim 1, characterized in that cylinders (30) are connected to said U-shaped bracket (24) on which idle rollers, 25, 26 are mounted in order to maintain the tension of the film according to the operating speed of the packager.

* * * * *